US011176909B2

(12) United States Patent
Yao et al.

(10) Patent No.: US 11,176,909 B2
(45) Date of Patent: Nov. 16, 2021

(54) COMPENSATION METHOD AND COMPENSATION DEVICE FOR DISPLAY SCREEN AS WELL AS DISPLAY DEVICE

(71) Applicant: BOE TECHNOLOGY GROUP CO., LTD., Beijing (CN)

(72) Inventors: Xing Yao, Beijing (CN); Mingfu Han, Beijing (CN); Guangliang Shang, Beijing (CN); Hao Zhu, Beijing (CN); Yifang Chu, Beijing (CN); Yunsik Im, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 38 days.

(21) Appl. No.: 16/633,026

(22) PCT Filed: May 28, 2019

(86) PCT No.: PCT/CN2019/088720
§ 371 (c)(1),
(2) Date: Jan. 22, 2020

(87) PCT Pub. No.: WO2020/093685
PCT Pub. Date: May 14, 2020

(65) Prior Publication Data

US 2020/0227006 A1 Jul. 16, 2020

(30) Foreign Application Priority Data

Nov. 8, 2018 (CN) ..... 201811323998.3

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2310/027* (2013.01); *G09G 2320/0242* (2013.01); *G09G 2320/0646* (2013.01)

(58) Field of Classification Search
CPC ..... G09G 5/10; G09G 3/20; G09G 2310/027; G09G 2320/0242; G09G 2320/0646
See application file for complete search history.

(56) References Cited

U.S. PATENT DOCUMENTS 6,704,757 B1 * 3/2004 Ohmi ..... G06N 3/0635 708/3
2003/0098836 A1 * 5/2003 Takei ..... G09G 3/3648 345/87

(Continued)

FOREIGN PATENT DOCUMENTS

CN 101105916 A 1/2008
CN 101521001 A 9/2009

(Continued)

OTHER PUBLICATIONS

Liu Dongni, Jun. 1, 2016, Translation of CN105629539A (Year: 2016).*

*Primary Examiner* — Dmitriy Bolotin
(74) *Attorney, Agent, or Firm* — The Webb Law Firm

(57) ABSTRACT

The present disclosure provides a compensation method, compensation device, and a display device. The compensation method includes: adjusting charging time for multiple areas of the display screen so that the charging time for each area is positively related to a distance from the area to a data voltage input terminal; comparing a first grayscale value before compensation of a sub-pixel in an i-th row and j-th column with a second grayscale value input to a sub-pixel in an (i−1)-th row and j-th column; searching a corresponding grayscale compensation parameter from a grayscale com- (Continued)

pensation parameter table according to the first grayscale value and the second grayscale value; compensating the first grayscale value by the grayscale compensation parameter to obtain a third grayscale value; and inputting the third grayscale value to the sub-pixel in the i-th row and j-th column for display.

15 Claims, 7 Drawing Sheets

(56) References Cited

U.S. PATENT DOCUMENTS

2012/0249620 A1* 10/2012 Choi ..... G09G 3/3688 345/694
2012/0280896 A1* 11/2012 Yamashita ..... G09G 3/3614 345/88
2013/0106920 A1* 5/2013 Park ..... G09G 3/3677 345/690
2013/0135186 A1* 5/2013 Zhang ..... G09G 3/3696 345/88
2015/0055042 A1* 2/2015 Chung ..... G02F 1/134309 349/42
2016/0247470 A1 8/2016 Tan
2018/0090083 A1 3/2018 Kim et al.
2018/0218705 A1 8/2018 Huang
2020/0227006 A1* 7/2020 Yao ..... G09G 3/2003

FOREIGN PATENT DOCUMENTS

CN 103745694 A 4/2014
CN 105629539 A 6/2016
CN 106023928 A 10/2016
CN 106297644 A 1/2017
CN 107610649 A 1/2018
CN 108182914 A 6/2018

* cited by examiner

COMPENSATION METHOD AND COMPENSATION DEVICE FOR DISPLAY SCREEN AS WELL AS DISPLAY DEVICE

CROSS-REFERENCE TO RELATED APPLICATIONS

The present application is a U.S. National Stage Application under 35 U.S.C. § 371 of International Patent Application No. PCT/CN2019/088720, filed on May 28, 2019, which claims priority to Chinese Patent Application No. 201811323998.3 filed on Nov. 8, 2018, the disclosure of both of which are incorporated by reference herein in entirety.

TECHNICAL FIELD

The present disclosure relates to a compensation method and a compensation device for a display screen, and a display device.

BACKGROUND

At present, there are higher and higher requirements for the display effect of the display screen. In order to meet the display requirements, the display technology of the display screen needs to be continuously improved. For example, the resolution, size or the like of the display screen need to be improved.

SUMMARY

According to one aspect of embodiments of the present disclosure, a compensation method for a display screen is provided. The compensation method comprises: adjusting charging time for a plurality of areas of the display screen so that the charging time for each area to be charged is positively related to a distance from the each area to a data voltage input terminal of the display screen; comparing a first grayscale value before compensation of a sub-pixel in an i-th row and j-th column with a second grayscale value input to a sub-pixel in an (i−1)-th row and j-th column, where i and j are both positive integers, and i>1; searching a grayscale compensation parameter corresponding to the first grayscale value and the second grayscale value from a grayscale compensation parameter table, in a case where the first grayscale value is not equal to the second grayscale value; compensating the first grayscale value by the grayscale compensation parameter to obtain a third grayscale value; and inputting the third grayscale value to the sub-pixel in the i-th row and j-th column for display.

In some embodiments, before comparing the first grayscale value with the second grayscale value, the compensation method further comprises: obtaining the grayscale compensation parameter table.

In some embodiments, the step of obtaining the grayscale compensation parameter table comprises: displaying a plurality of grayscale evaluation images by the display screen respectively, and obtaining an initial brightness value and an initial color coordinates of the display screen when each grayscale evaluation image is displayed, thereby obtaining a plurality of initial brightness values and a plurality of initial color coordinates corresponding to the plurality of grayscale evaluation images; calculating an initial chromaticity of the display screen corresponding to each grayscale evaluation image according to the initial brightness value and the initial color coordinates corresponding to the each grayscale evaluation image; calculating a chromaticity difference according to the initial chromaticity and a reference chromaticity, for each grayscale evaluation image, so as to obtain a plurality of chromaticity differences corresponding to the plurality of grayscale evaluation images; obtaining an average value of the chromaticity differences and a maximum value of the chromaticity differences according to the plurality of chromaticity differences; adjusting a grayscale value corresponding to each grayscale evaluation image input to the display screen, so that the average value of the chromaticity differences after adjustment is not greater than a first threshold and the maximum value of the chromaticity differences after adjustment is not greater than a second threshold; calculating a grayscale compensation parameter according to the grayscale value after adjustment and the grayscale value before adjustment; and obtaining the grayscale compensation parameter table according to the grayscale compensation parameter corresponding to each grayscale evaluation image.

In some embodiments, before obtaining the grayscale compensation parameter table according to the grayscale compensation parameter corresponding to each grayscale evaluation image, the compensation method further comprises: fitting a grayscale compensation curve according to a plurality of grayscale compensation parameters corresponding to the plurality of grayscale evaluation images; and obtaining all grayscale compensation parameters of the display screen according to the grayscale compensation curve.

In some embodiments, the initial chromaticity is calculated by a following equation: Initial chromaticity=L×a×b, wherein, L is the initial brightness value of the display screen when the display screen displays a grayscale evaluation image, a is an abscissa value of the initial color coordinates when the display screen displays the grayscale evaluation image, and b is an ordinate value of the initial color coordinates when the display screen displays the grayscale evaluation image.

In some embodiments, the grayscale compensation parameter is a difference between the grayscale value after adjustment and the grayscale value before adjustment.

In some embodiments, the first grayscale value is equal to the third grayscale value, in a case where the first grayscale value is equal to the second grayscale value.

In some embodiments, the display screen comprises a plurality of rows of sub-pixels, wherein the sub-pixels in a same row have a same color, and the sub-pixels in the i-th row and the sub-pixels in the (i−1)-th row have different colors.

In some embodiments, the plurality of rows of sub-pixels comprise a plurality of sub-pixel groups, each of the plurality of sub-pixel groups comprises adjacent red, green, and blue sub-pixel rows, and the adjacent red, green, and blue sub-pixel rows in the each of the plurality of sub-pixel groups share one gate driving unit.

In some embodiments, all sub-pixels in each area are charged for a same time.

According to another aspect of embodiments of the present disclosure, a compensation device for a display screen is provided. The compensation device comprises: a time compensation circuit configured to adjust charging time for a plurality of areas of the display screen so that the charging time for each area to be charged is positively related to a distance from the each area to a data voltage input terminal of the display screen; a storage circuit configured to store a grayscale compensation parameter table, wherein the grayscale compensation parameter table comprises grayscale compensation parameters; a grayscale compensation circuit configured to compare a first grayscale value before compensation of a sub-pixel in an i-th row and j-th column with a second grayscale value input to a sub-pixel in an (i−1)-th row and j-th column, where i and j are both positive integers, and i>1, search a grayscale compensation parameter corresponding to the first grayscale value and the second grayscale value from the grayscale compensation parameter table, in a case where the first grayscale value is not equal to the second grayscale value, compensate the first grayscale value by the grayscale compensation parameter to obtain a third grayscale value, and input the third grayscale value to the sub-pixel in the i-th row and j-th column for display.

In some embodiments, the display screen is configured to display a plurality of grayscale evaluation images respectively; and the grayscale compensation circuit is further configured to obtain an initial brightness value and an initial color coordinates of the display screen when each grayscale evaluation image is displayed, thereby obtain a plurality of initial brightness values and a plurality of initial color coordinates corresponding to the plurality of grayscale evaluation images, calculate an initial chromaticity of the display screen corresponding to each grayscale evaluation image according to the initial brightness value and the initial color coordinates corresponding to the each grayscale evaluation image, calculate a chromaticity difference according to the initial chromaticity and a reference chromaticity, for each grayscale evaluation image, so as to obtain a plurality of chromaticity differences corresponding to the plurality of grayscale evaluation images, obtain an average value of the chromaticity differences and a maximum value of the chromaticity differences according to the plurality of chromaticity differences, adjust a grayscale value corresponding to each grayscale evaluation image input to the display screen, so that the average value of the chromaticity differences after adjustment is not greater than a first threshold and the maximum value of the chromaticity differences after adjustment is not greater than a second threshold, calculate a grayscale compensation parameter according to the grayscale value after adjustment and the grayscale value before adjustment, and obtain the grayscale compensation parameter table according to the grayscale compensation parameter corresponding to each grayscale evaluation image.

In some embodiments, the grayscale compensation circuit is further configured to fit a grayscale compensation curve according to a plurality of grayscale compensation parameters corresponding to the plurality of grayscale evaluation images, and obtain all grayscale compensation parameters of the display screen according to the grayscale compensation curve.

According to another aspect of embodiments of the present disclosure, a compensation device for a display screen is provided. The compensation device comprises: a memory; and a processor coupled to the memory, wherein the processor is configured to perform the compensation method as described previously based on instructions stored in the memory.

According to another aspect of embodiments of the present disclosure, a display device is provided. The display device comprises the compensation device as described previously.

In some embodiments, the display device further comprises a display screen comprising a plurality of rows of sub-pixels, wherein the sub-pixels in a same row have a same color, and the sub-pixels in the i-th row and the sub-pixels in the (i−1)-th row have different colors.

In some embodiments, the plurality of rows of sub-pixels comprise a plurality of sub-pixel groups, each of the plurality of sub-pixel groups comprises adjacent red, green, and blue sub-pixel rows, and the adjacent red, green, and blue sub-pixel rows in the each of the plurality of sub-pixel groups share one gate driving unit.

According to another aspect of embodiments of the present disclosure, a computer readable storage medium is provided. The computer readable storage medium has stored thereon computer program instructions which, when executed by a processor, implement the steps of the compensation method as described previously.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description with reference to the accompanying drawings, in which.

Figure 1:
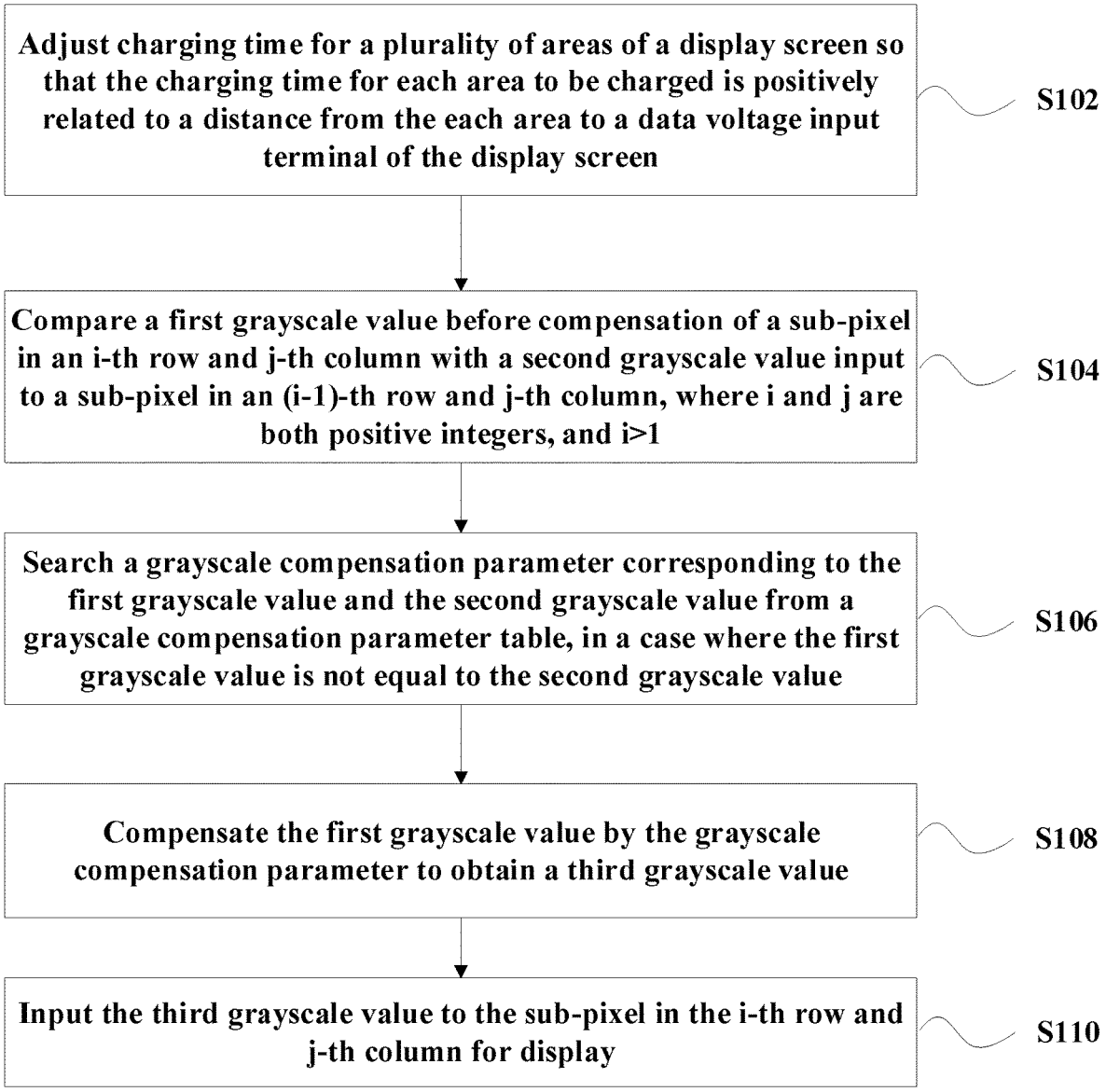
FIG. 1 is a flow chart showing a compensation method for a display screen according to an embodiment of the present disclosure.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical equations, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (comprising technical and scientific terms) used in the present disclosure have the same meanings as understood by those skilled in the art of the present disclosure unless otherwise defined. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventors of the present disclosure have found that, in the related art, the grayscale of the display screen may not reach a desired target grayscale value when the display screen displays an image, which results in a poor display effect.

In view of this, the embodiments of the present disclosure provide a compensation method for a display screen, so that the grayscale of the display screen may reach a desired target grayscale value when the display screen displays an image, thereby improving the display effect. The compensation method according to some embodiments of the present disclosure will be described in detail below in conjunction with the accompanying drawings.

FIG. 1 is a flow chart showing a compensation method for a display screen according to an embodiment of the present disclosure. As shown in FIG. 1, the compensation method comprise steps S102 to S110.

At step S102, charging time for a plurality of areas of the display screen is adjusted so that the charging time for each area to be charged is positively related to a distance from the each area to a data voltage input terminal of the display screen. That is, in the plurality of areas, the area farther from the data voltage input terminal is charged for a longer time.

Figure 2:
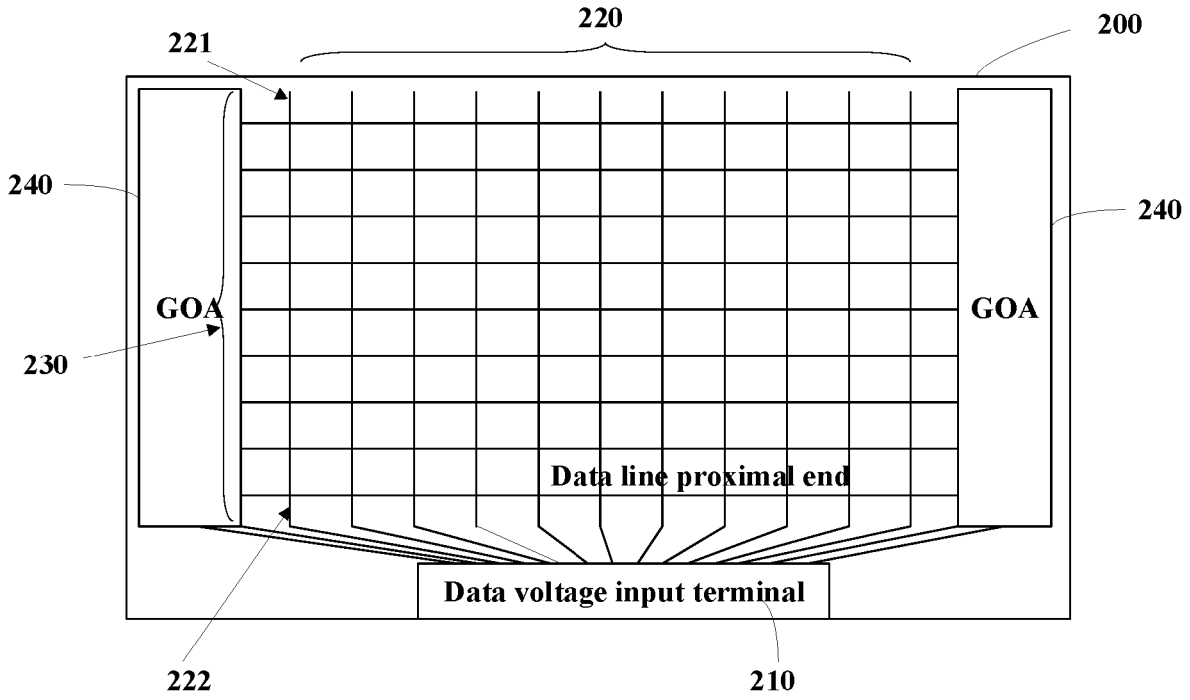
FIG. 2 is a structural view showing a display screen according to an embodiment of the present disclosure.

The structure of a display screen according to some embodiments of the present disclosure is described below in conjunction with FIG. 2. As shown in FIG. 2, the display screen comprise a data voltage input terminal 210, a plurality of data lines 220, a plurality of gate lines 230, and a GOA (Gate Driver On Array) circuit 240. The display screen further comprises a plurality of sub-pixels (not shown in FIG. 2), wherein each sub-pixel is located at a position where the data line 220 intersects with the gate line 230. In addition, FIG. 2 also shows a data line distal end 221 farther from the data voltage input terminal 210 and a data line proximal end 222 closer to the data voltage input terminal 210.

In some embodiments, the display screen may be divided into n areas (n is a positive integer), each of which comprises one or more rows of sub-pixels. The distance between the a-th area and the data voltage input terminal is A, and the distance between the b-th area and the data voltage input terminal is B, where $1 \le a \le b \le n$ and a and b are both positive integers, and $A<B$, so that the time for the a-th area to be charged is less than the time for the b-th area to be charged.

For example, if one area consists in a row of sub-pixels, the distance between the area and the data voltage input terminal may be the distance from a connection point of the row of sub-pixels and the data line to the data voltage input terminal. For another example, if one area comprises multiple rows of sub-pixels, the distance between the area and the data voltage input terminal may be a minimum distance or average distance from the connection point of the multiple rows of sub-pixels and the data line to the data voltage input terminal.

In some embodiments, all sub-pixels in each area are charged for a same time. That is, for each area, it may be provided that all sub-pixels in the area are charged for the same time. This may facilitate adjusting the charging time.

In some embodiments, the sum of the time for all rows of sub-pixels to be charged is less than or equal to the time for the display screen to display one frame of image.

In the related art, due to a large load and a short charging time of the display screen, there is a great difference in the charging rate of the entire screen, which causes a poor color display performance of the display screen. For example, an area of the display screen farther from the data voltage input terminal (which may be referred to as a distal area) has a charging rate of 50%, and an area closer to the data voltage input terminal (which may be referred to as a proximal area) has a charging rate of 80%. Therefore, there might be a problem of inadequate charging in the distal area, which may result in a poor color display performance of the display screen. Here, the charging rate refers to a ratio of a highest voltage written in a sub-pixel electrode to a data voltage within a sub-pixel charging period.

In the above-described steps, the display screen may be divided into a plurality of areas according to the distance from the data voltage input terminal. For example, the data voltage input terminal is on an upper part of the display screen. A plurality of rows of sub-pixels of the display screen may be divided into a plurality of e areas according to the distance from the data voltage input terminal. The area closer to the data voltage input terminal is a proximal area, and the area farther from the data voltage input terminal is a distal area. Of course, there may also be some sub-proximal or sub-distal areas between the proximal area and the distal area. Each area may comprise one or more rows of sub-pixels.

Figure 3:
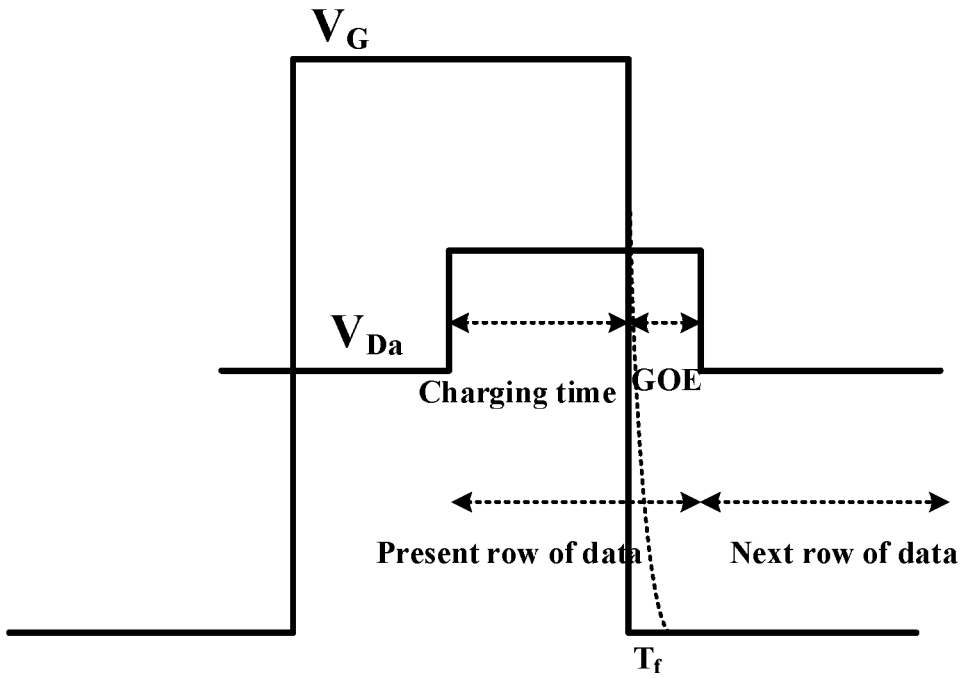
FIG. 3 is a timing chart showing a gate driving signal and a data signal according to an embodiment of the present disclosure.

Here, the charging time according to the embodiments of the present disclosure may be described in conjunction with FIG. 3. As shown in FIG. 3, a gate drive signal $V_G$ having a positive pulse is applied to the gate line so as to perform a charging operation, thereby actuating an input path for inputting a data signal $V_{Da}$ into a pixel circuit in the display screen. The data signal $V_{Da}$ has a time overlapping with the gate driving signal $V_G$, that is, a charging time. Moreover, the data signal $V_{Da}$ also has a delay portion after a falling edge of the gate driving signal $V_G$, i.e. GOE (Gate Output Enable). In a desirable case, the GOE is set within a duration $T_f$ of the falling edge, so that the gate line is completely turned off before the data signal is completely loaded to a current row of sub-pixels. The GOE may prevent an erroneous operation of charging a next row of data signals into a previous row of sub-pixels.

During charging, the charging time for the plurality of areas of the display screen may be adjusted, so that the charging time for each area is positively related to the distance from the area to the data voltage input terminal of the display screen. For example, the most distal area may be charged for 5 microseconds, and the most proximal area may be charged for 2 microseconds. By adjusting the charging time for different areas, the charging rate of the entire display may be made as consistent as possible. For example, the charging rates for all areas may be made to be about 60%. This may reduce display problems such as color deviation caused by an excessively low charging rate.

Returning to FIG. 1, at step S104, a first grayscale value before compensation of a sub-pixel in an i-th row and j-th column is compared with a second grayscale value input to a sub-pixel in an (i−1)-th row and j-th column, where i and j are both positive integers, and i>1.

For example, it may be determined whether the first grayscale value before compensation of the sub-pixel in the i-th row and j-th column is equal to the second grayscale value input to the sub-pixel in the (i−1)-th row and j-th column. If the first grayscale value is not equal to the second grayscale value, the process proceeds to step S106. If the first grayscale value is equal to the second grayscale value, the first grayscale value may not be compensated, that is, the first grayscale value is directly input to the sub-pixel in the i-th row and j-th column to make the sub-pixel emit light.

At step S106, a grayscale compensation parameter corresponding to the first grayscale value and the second grayscale value is searched from a grayscale compensation parameter table, in a case where the first grayscale value is not equal to the second grayscale value.

For example, Table 1 is an exemplary grayscale compensation parameter table. In this Table 1, "Present row" represents a first grayscale value of the sub-pixel in the i-th row (for example, in the i-th row and j-th column). The first grayscale value is also a target grayscale value of the sub-pixel in the i-th row and j-th column. "Previous row" represents a second grayscale value input to the sub-pixel in the (i−1)-th row (for example, in the (i−1)-th row and j-th column). For example, the second grayscale value is also a target grayscale value of the sub-pixel in the (i−1)-th row and j-th column. "Compensation parameter" represents a grayscale compensation parameter. For example, "L0" represents that the target grayscale value is 0, "L32" represents that the target grayscale value is 32, "L255" represents that the target grayscale value is 255, and so on.

TABLE 1

Exemplary grayscale compensation parameter table

| | Compensation parameter Previous row | | | | | | | | |
|---|---|---|---|---|---|---|---|---|---|
| Present row | L0 | L32 | L64 | L96 | L128 | L160 | L192 | L224 | L255 |
| L0 | 0 | 0 | 0 | 0 | 0 | 0 | 0 | 0 | 0 |
| L32 | 8 | 0 | 0 | 0 | 0 | 0 | 0 | 0 | 0 |
| L64 | 16 | 0 | 0 | 0 | 0 | 0 | 0 | 0 | 0 |
| L96 | 24 | 14 | 4 | 0 | 0 | −6 | −6 | −6 | −11 |
| L128 | 32 | 14 | 14 | 9 | 0 | −6 | −6 | −8 | −23 |
| L160 | 32 | 14 | 14 | 14 | 5 | 0 | −6 | −6 | −20 |
| L192 | 26 | 14 | 8 | 18 | 5 | 0 | 0 | −6 | −12 |
| L224 | 14 | 6 | 4 | 9 | 5 | 5 | 0 | 0 | −14 |
| L255 | 0 | 0 | 0 | 0 | 0 | 0 | 0 | 0 | 0 |

It should be noted that, Table 1 which contains 9×9 grayscale compensation parameters, is only exemplary. Those skilled in the art may understand that, the grayscale compensation parameter table may contain other amounts (e.g., 81×81, 256×256, etc.) of grayscale compensation parameters. Therefore, the scope of the embodiments of the present disclosure is not limited thereto.

For example, the first grayscale value (i.e., the target grayscale value) before compensation of the sub-pixel in the i-th row and j-th column is 96, and the second grayscale value input to the sub-pixel in the (i−1)-th row and j-th column is 64, so that it may be searched from Table 1 that, the corresponding grayscale compensation parameter is 4.

In some embodiments, the first grayscale value is equal to the third grayscale value, in a case where the first grayscale value is equal to the second grayscale value. In other words, in the case where the first grayscale value is equal to the second grayscale value, the first grayscale value may not be compensated, and the first grayscale value may be directly input to the sub-pixel in the i-th row and j-th column.

In some embodiments, the display screen comprises a plurality of rows of sub-pixels. The sub-pixels in the same row have the same color. The sub-pixels in the i-th row and the sub-pixels in the (i−1)-th row have different colors.

For example, in a case where the sub-pixel in the i-th row and j-th column is a red sub-pixel, the sub-pixel in the (i−1)-th row and j-th column may be a blue sub-pixel. In a case where the sub-pixel in the i-th row and j-th column is a green sub-pixel, the sub-pixel in the (i−1)-th row and j-th column may be a red sub-pixel. In a case where the sub-pixel in the i-th row and j-th column is a blue sub-pixel, the sub-pixel in the (i−1)-th row and j-th column may be a green sub-pixel. Of course, those skilled in the art may understand that, the sub-pixel in the i-th row and j-th column and the sub-pixel in the (i−1)-th row and j-th column which may also be arranged in other manners, are not only limited to the color arrangement manner disclosed herein.

In some embodiments, the grayscale compensation parameter table may comprise: a grayscale compensation parameter table for a red sub-pixel, a grayscale compensation parameter table for a green sub-pixel, and a grayscale compensation parameter table for a blue sub-pixel. Here, the grayscale compensation parameter table for the red sub-pixel refers to a grayscale compensation parameter table when the sub-pixel in the present row (i.e. the i-th row) is the red sub-pixel, the grayscale compensation parameter table for the green sub-pixel refers to a grayscale compensation parameter table when the sub-pixel in the present row is the green sub-pixel, and the grayscale compensation parameter table for the blue sub-pixel refers to a grayscale compensation parameter table when the sub-pixel in the present row is the blue sub-pixel.

In some embodiments, in the case where the sub-pixel in the i-th row and j-th column is a red sub-pixel, the corresponding gray-scale compensation parameter is searched from the gray-scale compensation parameter table for the red sub-pixel. In the case where the sub-pixel in the i-th row and j-th column is a green sub-pixel, the corresponding gray-scale compensation parameter is searched from the gray-scale compensation parameter table for the green sub-pixel. In the case where the sub-pixels in the i-th row and j-th column is the blue sub-pixel, the corresponding gray-scale compensation parameter is searched from the gray-scale compensation parameter table for the blue sub-pixel.

At step S108, the first grayscale value is compensated by the grayscale compensation parameter to obtain a third grayscale value.

In some embodiments, the step S108 comprises: the third grayscale value is the sum of the first grayscale value and the grayscale compensation parameter.

For example, the first grayscale value (i.e., the target grayscale value) $GL_{i,j}$ before compensation of the sub-pixel in the i-th row and j-th column is 96, and the second grayscale value $GL_{i-1,j}$ input to the sub-pixel in the (i−1)-th row and j-th column is 64. It may be searched from Table 1 that the corresponding grayscale compensation parameter P is 4, so that the third grayscale value $GL'_{i,j}$ is $GL'_{i,j}=GL_{i,j}+P=96+4=100$. In this example, the sub-pixel in the i-th row and j-th column needs to display a target grayscale value of 96. However, in the case where the grayscale value of the sub-pixel in the previous row is 64, if the grayscale value of the sub-pixel in the i-th row and j-th column is to reach 96, it is necessary to input a grayscale value of 100 to the sub-pixel in the i-th row and j-th column, so that the grayscale value of the sub-pixel in the i-th row and j-th column during display may reach 96.

In some embodiments, in the case where the sub-pixel in the i-th row and j-th column is the red sub-pixel, and the sub-pixel in the (i−1)-th row and j-th column is the blue sub-pixel, the grayscale value after compensation of the red sub-pixel in the i-th row and j-th column is calculated by the following formula:

$$R'_{i,j}=P_{R(i,j)-B(i-1,j)}+R_{i,j}, \quad (1)$$

wherein, $R'_{i,j}$ is the grayscale value (that is, the third grayscale value) after the compensation of the red sub-pixel, $R_{i,j}$ is the first grayscale value before compensation of the red sub-pixel, $P_{R(i,j)-B(i-1,j)}$ is the searched corresponding grayscale compensation parameter.

In some embodiments, in the case where the sub-pixel in the i-th row and j-th column is the green sub-pixel, and the sub-pixel in the (i−1)-th row and j-th column is the red sub-pixel, the grayscale value after compensation of the green sub-pixel in the i-th row and j-th column is calculated by the following formula:

$$G'_{i,j}=P_{G(i,j)-R(i-1,j)}+G_{i,j}, \quad (2)$$

wherein, $G'_{i,j}$ is the grayscale value (that is, the third grayscale value) after the compensation of the green sub-pixel, $G_{i,j}$ is the first grayscale value before compensation of the green sub-pixel, $P_{G(i,j)-R(i-1,j)}$ is the searched corresponding grayscale compensation parameter.

In some embodiments, in the case where the sub-pixel in the i-th row and j-th column is the blue sub-pixel, and the sub-pixel in the (i−1)-th row and j-th column is the green sub-pixel, the grayscale value after compensation of the blue sub-pixel in the i-th row and j-th column is calculated by the following formula:

$$B'_{i,j}=P_{B(i,j)-G(i-1,j)}+B_{i,j}, \quad (3)$$

wherein, $B'_{i,j}$ is the grayscale value (that is, the third grayscale value) after the compensation of the blue sub-pixel, $B_{i,j}$ is the first grayscale value before compensation of the blue sub-pixel, $P_{B(i,j)-G(i-1,j)}$ is the searched corresponding grayscale compensation parameter.

At step S110, the third grayscale value is input to the sub-pixel in the i-th row and j-th column for display.

In some embodiments, after compensating the first grayscale value of the sub-pixel in the i-th row and j-th column and perform display by using the grayscale value after compensation, the first grayscale value of the next sub-pixel (e.g., the sub-pixel in the i-th row and (j+1)-th column) is compensated and the display is performed by using the grayscale value after compensation. For example, the steps S104 to S110 may be repeatedly performed to compensate the first grayscale value of sub-pixel in the i-th row and (j+1)-th column and perform the display by using the grayscale value after compensation.

So far, a compensation method for a display screen according to some embodiments of the present disclosure is provided. In the compensation method, the charging time for the plurality of areas of the display screen is adjusted so that the charging time for each area to be charged is positively related to the distance from the each area to the data voltage input terminal of the display screen. The first grayscale value before compensation of the sub-pixel in the i-th row and j-th column is compared with the second grayscale value input to the sub-pixel in the (i−1)-th row and j-th column, where i and j are both positive integers, and i>1. A grayscale compensation parameter corresponding to the first grayscale value and the second grayscale value is searched from the grayscale compensation parameter table in the case where the first grayscale value is not equal to the second grayscale value. The first grayscale value is compensated by the searched grayscale compensation parameter to obtain a third grayscale value. The third grayscale value is input to the sub-pixel in the i-th row and the j-th column for display. By adjusting the charging time for different areas, the charging rate of the entire display screen may be made as consistent as possible. By compensating the grayscale, it is possible to allow that the display screen when displaying an image may reach a desired target grayscale value, thereby improving the display effect.

For example, it is indicated by experiment that, the grayscale value of a green sub-pixel pixel is compensated from 127 to 177, its brightness is increased from 25.68 to 40.65, and its color coordinates is changed from (0.2732, 0.2501) to (0.2818, 0.3217), so that the display effect may be improved.

Figure 4:
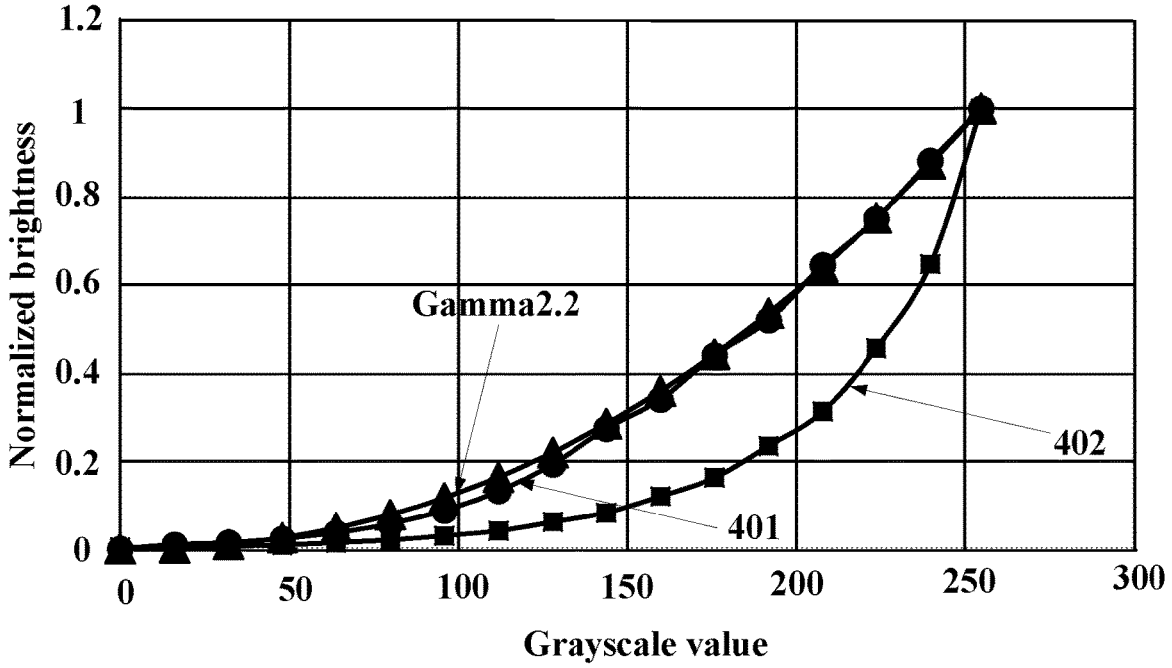
FIG. 4 is an experimental result view showing gamma curves of a display screen according to some embodiments of the present disclosure.

For another example, FIG. 4 is an experimental result view showing gamma curves of a display screen according to some embodiments of the present disclosure. FIG. 4 shows the gamma curve gamma 2.2, the gamma curve 401 of the pixel unit group (e.g., one pixel unit group may comprise a red sub-pixel R, a green sub-pixel G, and a blue sub-pixel B) after compensation and the gamma curve 402 of the pixel unit group before compensation. As shown in FIG. 4, compared with the gamma curve 402 of the pixel unit group before compensation, the gamma curve 401 of the pixel unit group after compensation obtained by experiment after implementing the above-described compensation method is closer to the gamma curve gamma 2.2. This shows that, the above-described compensation method may achieve a better compensation effect.

The compensation method according to the above-described embodiments which may be applied to a product with a low charging rate due to a short charging time and a great load, has a wide application range and is high feasible in mass production.

In addition, it should be noted that, for the sub-pixels in the first row, it may be considered that the sub-pixels in the first row can reach the input target grayscale value when emitting light, so it is not necessary to compensate the grayscale values of the sub-pixels in the first row.

In some embodiments, the GOA circuit comprises a plurality of gate driving units. The structure of the gate driving unit according to some embodiments is described in detail below in conjunction with FIGS. 5 and 6 respectively.

Figure 5:
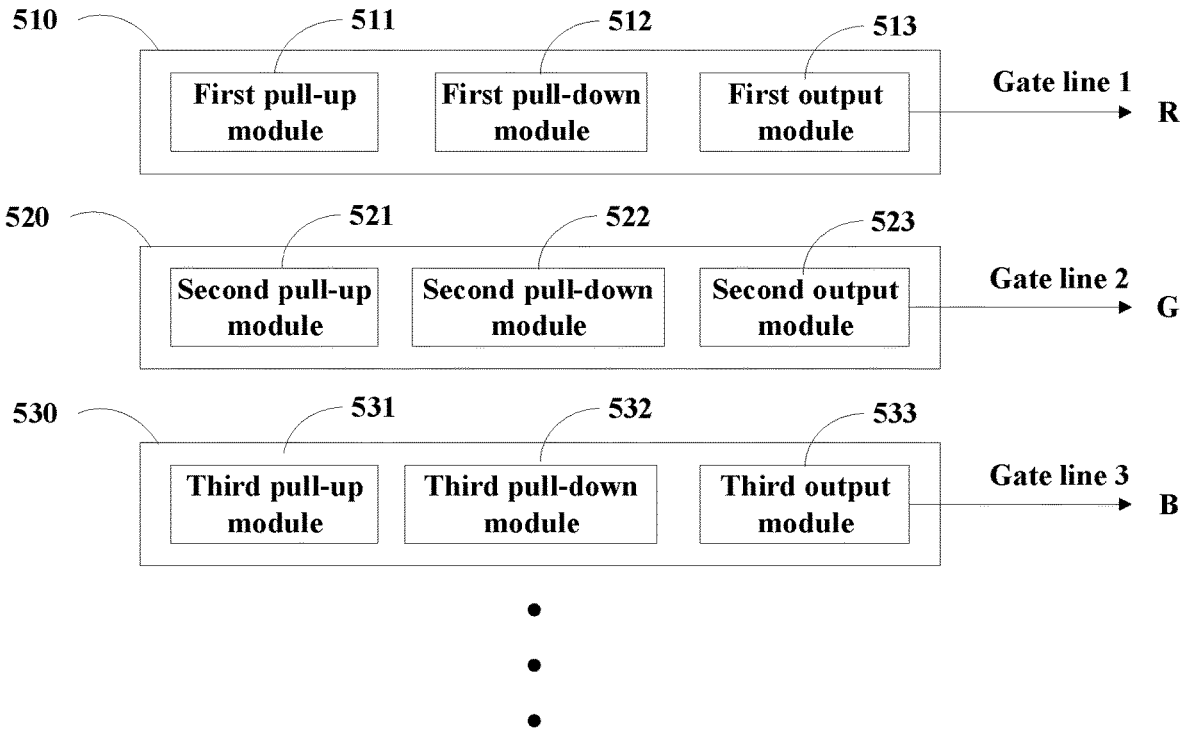
FIG. 5 is a schematic structural view showing gate driving units according to some embodiments.

FIG. 5 is a schematic structural view showing gate driving units according to some embodiments. For example, FIG. 5 shows three gate driving units, that is, a first gate driving unit 510, a second gate driving unit 520, and a third gate driving unit 530. The first gate driving unit 510 comprises a first pull-up module 511, a first pull-down module 512, and a first output module 513. The second gate driving unit 520 comprises a second pull-up module 521, a second pull-down module 522, and a second output module 523. The third gate driving unit 530 comprises a third pull-up module 531, a third pull-down module 532, and a third output module 533. Each gate driving unit is electrically connected to one gate line. The gate driving unit is configured to output a gate driving signal to the sub-pixels in a corresponding row. Here, the sub-pixels in the same row have the same color. For example, the first gate driving unit 510 outputs a gate driving signal to a red sub-pixel row through a first gate line 1, the second gate driving unit 520 outputs a gate driving signal to a green sub-pixel row through a second gate line 2, and the third gate driving unit 530 outputs a gate driving signal to a blue sub-pixel row through a third gate line 3. In FIG. 4, R represents a red sub-pixel, G represents a green sub-pixel, and B represents a blue sub-pixel, which is similar below.

In other embodiments, the plurality of rows of sub-pixels of the display screen comprise a plurality of sub-pixel groups. Each of the plurality of sub-pixel groups comprises adjacent red, green, and blue sub-pixel rows. The adjacent red, green, and blue sub-pixel rows in the each of the plurality of sub-pixel groups share one gate driving unit.

Figure 6:
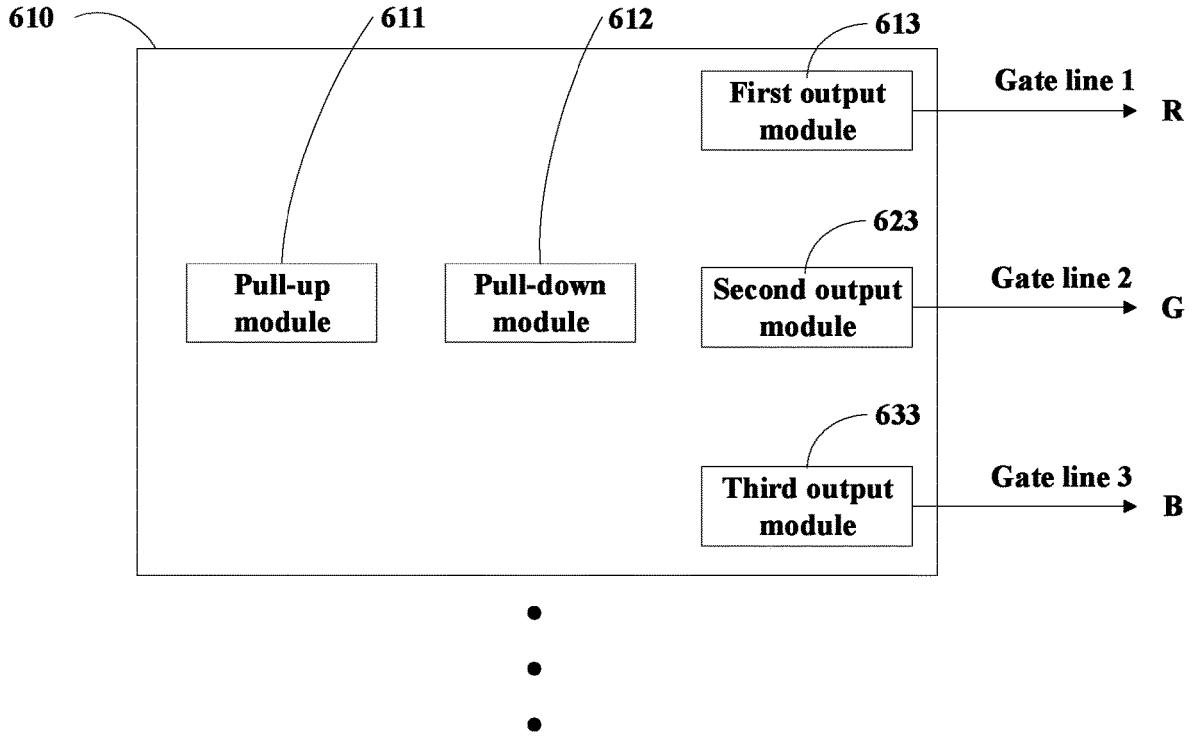
FIG. 6 is a schematic structural view showing a gate driving unit according to an embodiment of the present disclosure.

FIG. 6 is a schematic structural view showing a gate driving unit according to an embodiment of the present disclosure. As shown in FIG. 6, the gate driving unit (which may be referred to as a tri-gate GOAunit) 610 may comprise a pull-up module 611, a pull-down module 612, a first output module 613, a second output module 623, and a third output module 633. The first output module 613 is electrically connected to a red sub-pixel row through a first gate line 1, the second output module 623 is electrically connected to a green sub-pixel row through a second gate line 2, and the third output module 633 is electrically connected to a blue sub-pixel row through a third gate line 3. In this way, the adjacent red, green, and blue sub-pixel rows share one gate driving unit 610. The gate driving unit 610 outputs gate driving signals to the red sub-pixel row, the green sub-pixel row, and the blue sub-pixel respectively.

Compared with the GOA circuit based on the gate driving unit shown in FIG. 5, the GOA circuit based on the gate driving unit shown in FIG. 6 may save one third of the transistors for each gate line. By installing a GOA circuit with a relatively small number of transistors in the frame of the display screen, it is favorable for reducing the width of the frame of the display screen. The gate driving unit shown in FIG. 6 has a great load, a short charging time (e.g., the charging time is 2.5 μs), which causes a great difference in the charging rate of the entire screen. For example, the equivalent resistance $R_{data}$ of the data line is 2.8 kΩ, and the equivalent capacitance $C_{data}$ when the data line overlaps with other signal lines or electrodes is 422 pf, which indicates that the gate driving unit shown in FIG. 6 has a great load. For example, the charging rate on the DP (Data Pad, that is, the data signal input terminal) side is 80%, and the DPO (Data Pad Opposite, side opposite to the data signal input terminal) side is 50%, which indicates that the entire screen has a great difference in the charging rate. The compensation method according to the embodiments of the present disclosure may be applied to a display screen having the gate driving unit shown in FIG. 6 so as to improve the display effect.

In some embodiments, before comparing the first grayscale value with the second grayscale value (i.e., step S104), the compensation method may further comprise: obtaining the grayscale compensation parameter table.

The process of obtaining the grayscale compensation parameter table will be described in detail below in conjunction with FIG. 7.

Figure 7:
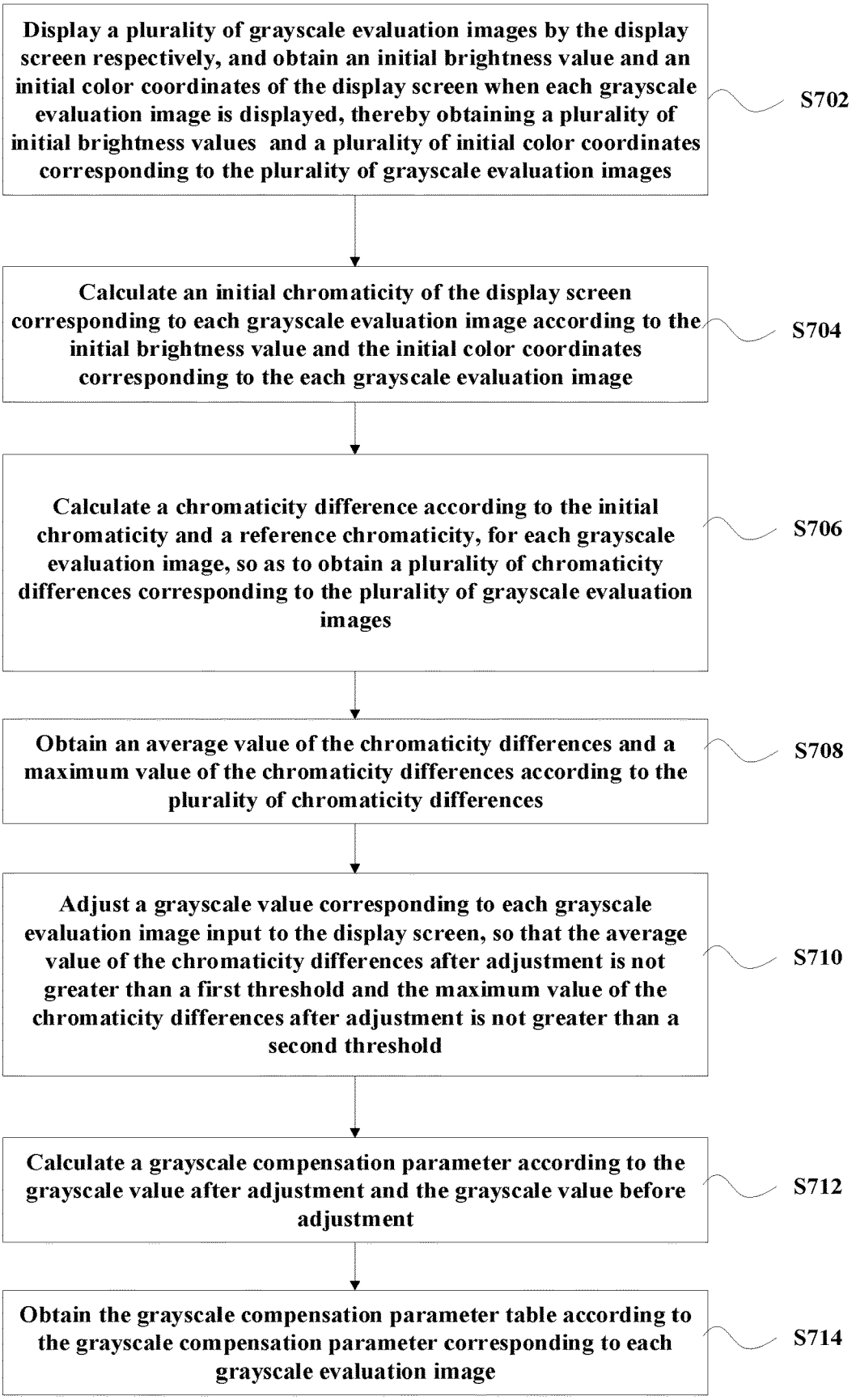
FIG. 7 is a flow chart showing a method for obtaining a grayscale compensation parameter table according to an embodiment of the present disclosure.

FIG. 7 is a flow chart showing a method for obtaining a grayscale compensation parameter table according to an embodiment of the present disclosure. The method may comprise steps S702 to S714.

At step S702, a plurality of grayscale evaluation images are displayed by the display screen respectively, and an initial brightness value and an initial color coordinates of the display screen are obtained when each grayscale evaluation image is displayed, thereby obtaining a plurality of initial brightness values and a plurality of initial color coordinates corresponding to the plurality of grayscale evaluation images.

For example, the display screen displays 81 grayscale evaluation images respectively. In the case of displaying each grayscale evaluation image, an initial brightness value L and an initial color coordinates (a, b) of the display screen when the grayscale evaluation image is displayed may be measured by, for example, a sensor. In this way, in the case where the display screen displays a plurality of grayscale evaluation images respectively, the plurality of initial brightness values and the plurality of initial color coordinates may be obtained.

At step S704, an initial chromaticity of the display screen corresponding to each grayscale evaluation image is calculated according to the initial brightness value and the initial color coordinates corresponding to the each grayscale evaluation image.

For example, the initial chromaticity is calculated by the following equation:

$$\text{Initial chromaticity}=L\times a\times b, \tag{4}$$

wherein, L is the initial brightness value of the display screen when the display screen displays a grayscale evaluation image, a is an abscissa value of the initial color coordinates when the display screen displays the grayscale evaluation image, and b is an ordinate value of the initial color coordinates when the display screen displays the grayscale evaluation image. Here, in the case where the plurality of initial brightness values and the plurality of initial color coordinates are obtained, a plurality of initial chromaticities may be obtained.

At step S706, for each grayscale evaluation image, a chromaticity difference is calculated according to the initial chromaticity and a reference chromaticity, so as to obtain a plurality of chromaticity differences corresponding to the plurality of grayscale evaluation images.

For example, it is possible to compare the initial chromaticity of the display screen with the reference chromaticity of a reference color card, and calculate a chromaticity difference therebetween:

$$\text{Chromaticity difference}=\text{Initial chromaticity}-\text{Reference chromaticity}. \quad (5)$$

Here, in the case of having the above-described multiple initial chromaticities, there are a corresponding number of reference chromaticities of reference color cards, so that the plurality of chromaticity differences may be obtained.

For example, the reference chromaticities of the reference color cards may be initial chromaticities when 81 grayscale evaluation images are displayed in the proximal area (that is, the area under the best charging condition) that is closer to the data voltage input terminal before compensation of the charging time.

At step S708, an average value of the chromaticity differences and a maximum value of the chromaticity differences are obtained according to the plurality of chromaticity differences.

Here, the average value of the chromaticity differences refers to an average value of the corresponding chromaticity differences when the above-described multiple grayscale evaluation images are displayed. The maximum value of the chromaticity differences refers to a maximum value of the corresponding chromaticity differences when the above-described multiple grayscale evaluation images are displayed.

At step S710, a grayscale value corresponding to each grayscale evaluation image input to the display screen is adjusted, so that the average value of the chromaticity differences after adjustment is not greater than a first threshold and the maximum value of the chromaticity differences after adjustment is not greater than a second threshold. Here, the first threshold and the second threshold may be determined according to actual needs. For example, the "ΔE2000" chromaticity evaluation system may be used to adjust the grayscale value corresponding to the grayscale evaluation image. For example, the first threshold is 3 and the second threshold is 5.

For example, the grayscale values of the display screen are adjusted when 81 grayscale evaluation images are displayed respectively, and the 81 chromaticity differences are calculated respectively, so that the average value of the 81 chromaticity differences is less than or equal to the first threshold, and the maximum value of the 81 chromaticity differences is less than or equal to the second threshold. If this condition is not satisfied, the grayscale value of the display screen with a large chromaticity difference is searched when the 81 grayscale evaluation images are displayed, and the grayscale value again is adjusted until the above-described condition is satisfied.

Here, in the case where the grayscale value of the display screen is adjusted, there is a need to adjust the grayscale value of each sub-pixel of the display screen. In some embodiments, when a grayscale evaluation image is designed, the grayscale values of the RGB (red, green, and blue) sub-pixels may satisfy the following characteristics: when the RGB sub-pixels respectively emit light according to the respective grayscale values, the display screen can display a specific color by the entire screen. This may make the grayscale compensation parameters corresponding to the sub-pixels of the same color to be the same, which facilitates adjusting the grayscale value of each sub-pixel of the display screen.

At step S712, a grayscale compensation parameter is calculated according to the grayscale value after adjustment and the grayscale value before adjustment.

For example, after the grayscale value of the display screen is adjusted to satisfy the condition of the step S710, the grayscale compensation parameter is calculated. The grayscale compensation parameter is the difference between the grayscale after adjustment and the grayscale value before adjustment.

At step S714, a grayscale compensation parameter table is obtained according to the grayscale compensation parameter corresponding to each grayscale evaluation image.

For example, in the case where 81 grayscale evaluation images are used, 81 grayscale compensation parameters may be obtained through the previous steps, so that a 9×9 grayscale compensation parameter table may be formed. For example, the grayscale compensation parameter table may comprise grayscale compensation parameters corresponding to several grayscale values from 0 to 255 grayscales.

So far, a method for obtaining a grayscale compensation parameter table according to some embodiments of the present disclosure is provided. By the above-described method, the grayscale compensation parameters corresponding to several grayscale values may be obtained, thereby obtaining the grayscale compensation parameter table.

In some embodiments, before the step S714, the compensation method further comprise: fitting a grayscale compensation curve according to a plurality of grayscale compensation parameters corresponding to the plurality of grayscale evaluation images; and obtaining all grayscale compensation parameters of the display screen according to the grayscale compensation curve. By fitting the grayscale compensation curve and obtaining all the grayscale compensation parameters according to the grayscale compensation curve, it is possible to obtain a more complete grayscale compensation parameter table.

Figure 8:
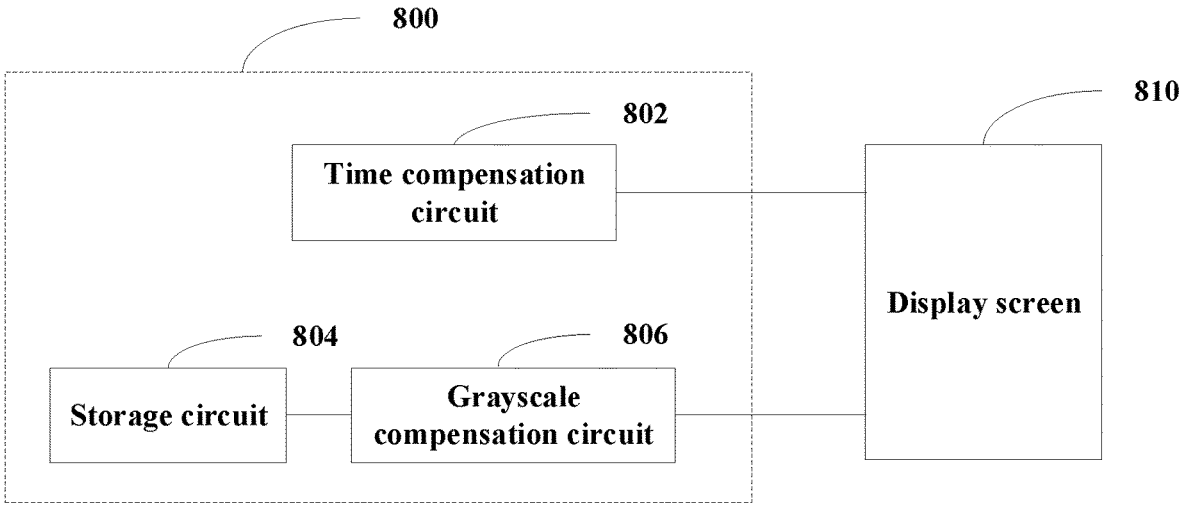
FIG. 8 is a schematic structural view showing a compensation device for a display screen according to an embodiment of the present disclosure.

FIG. 8 is a schematic structural view showing a compensation device for a display screen according to an embodiment of the present disclosure. As shown in FIG. 8, the compensation device 800 comprises a time compensation circuit 802, a storage circuit 804, and a grayscale compensation circuit 806. The time compensation circuit 802 is electrically connected to a display screen 810. The grayscale compensation circuit 806 is electrically connected to the storage circuit 804 and the display screen 810 respectively.

The time compensation circuit 802 is configured to adjust charging time for a plurality of areas of the display screen 810 so that the charging time for each area to be charged is positively related to a distance from the each area to a data voltage input terminal of the display screen. For example, all sub-pixels in each area are charged for the same time.

The storage circuit 804 is configured to store a grayscale compensation parameter table. The grayscale compensation parameter table comprises grayscale compensation parameters.

The grayscale compensation circuit 806 is configured to compare a first grayscale value before compensation of a sub-pixel in an i-th row and j-th column with a second grayscale value input to a sub-pixel in an (i−1)-th row and j-th column, where i and j are both positive integers, and i>1. The grayscale compensation circuit 806 is further configured to search a grayscale compensation parameter corresponding to the first grayscale value and the second grayscale value from the grayscale compensation parameter table in a case where the first grayscale value is not equal to the second grayscale value, and compensate the first grayscale value by the grayscale compensation parameter to obtain a third grayscale value. The grayscale compensation circuit 806 is further configured to input the third grayscale value to the sub-pixel in the i-th row and j-th column for display.

For example, the third grayscale value is the sum of the first grayscale value and the grayscale compensation parameter.

Hitherto, a compensation device according to some embodiments of the present disclosure is provided. The compensation device adjusts the charging time for different areas, so that the charging rate of the entire display may be made as consistent as possible. The compensation device compensates the grayscale, so that it is possible to allow that the display screen when displaying an image may reach a desired target grayscale value, thereby improving the display effect.

In some embodiments, the grayscale compensation parameter table may comprise: a grayscale compensation parameter table for a red sub-pixel, a grayscale compensation parameter table for a green sub-pixel, and a grayscale compensation parameter table for a blue sub-pixel.

The grayscale compensation circuit 806 is configured to search the corresponding gray-scale compensation parameter from the gray-scale compensation parameter table for the red sub-pixel in a case where the sub-pixel in the i-th row and j-th column is the red sub-pixel.

The grayscale compensation circuit 806 is configured to search the corresponding gray-scale compensation parameter from the gray-scale compensation parameter table for the green sub-pixel in a case where the sub-pixel in the i-th row and j-th column is the green sub-pixel.

The grayscale compensation circuit 806 is configured to search the corresponding gray-scale compensation parameter from the gray-scale compensation parameter table for the blue sub-pixel in a case where the sub-pixel in the i-th row and the j-th column is the blue sub-pixel.

In some embodiments, the grayscale compensation circuit 806 is further configured to obtain the grayscale compensation parameter table and transmit the grayscale compensation parameter table to the storage circuit 804 so that the storage circuit 804 stores the grayscale compensation parameter table.

In some embodiments, the display screen 810 is configured to display a plurality of grayscale evaluation images respectively. The grayscale compensation circuit 806 is further configured to obtain an initial brightness value and an initial color coordinates of the display screen when each grayscale evaluation image is displayed, thereby obtaining a plurality of initial brightness values and a plurality of initial color coordinates corresponding to the plurality of grayscale evaluation images. The grayscale compensation circuit 806 is further configured to calculate an initial chromaticity of the display screen corresponding to each grayscale evaluation image according to the initial brightness value and the initial color coordinates corresponding to the each grayscale evaluation image. The grayscale compensation circuit 806 is further configured to calculate a chromaticity difference according to the initial chromaticity and a reference chromaticity, for each grayscale evaluation image, so as to obtain a plurality of chromaticity differences corresponding to the plurality of grayscale evaluation images. The grayscale compensation circuit 806 is further configured to obtain an average value of the chromaticity differences and a maximum value of the chromaticity differences according to the plurality of chromaticity differences. The grayscale compensation circuit 806 is further configured to adjust a grayscale value corresponding to each grayscale evaluation image input to the display screen, so that the average value of the chromaticity differences after adjustment is not greater than a first threshold and the maximum value of the chromaticity differences after adjustment is not greater than a second threshold. The grayscale compensation circuit 806 is further configured to calculate a grayscale compensation parameter according to the grayscale value after adjustment and the grayscale value before adjustment. The grayscale compensation circuit 806 is further configured to obtain a grayscale compensation parameter table according to the grayscale compensation parameter corresponding to each grayscale evaluation image.

In some embodiments, the grayscale compensation circuit 806 is further configured to fit a grayscale compensation curve according to a plurality of grayscale compensation parameters corresponding to the plurality of grayscale evaluation images, and obtain all grayscale compensation parameters of the display screen according to the grayscale compensation curve.

Figure 9:
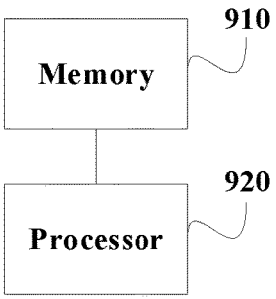
FIG. 9 is a schematic structural view showing a compensation device for a display screen according to another embodiment of the present disclosure.

FIG. 9 is a schematic structural view showing a compensation device for a display screen according to another embodiment of the present disclosure. The compensation device comprises a memory 910 and a processor 920.

The memory 910 may be a magnetic disk, a flash memory, or any other non-volatile storage medium. The memory is configured to store instructions in the embodiments corresponding to FIG. 1 or 7.

The processor 920 which is coupled to the memory 910, may be implemented as one or more integrated circuits, such as a microprocessor or a microcontroller. The processor 920 is configured to execute instructions stored in the memory. By adjusting the charging time for different areas, the charging rate of the entire display may be made as consistent as possible. By compensating the grayscale, it is possible to allow that the display screen when displaying an image may reach a desired target grayscale value, thereby improving the display effect.

Figure 10:
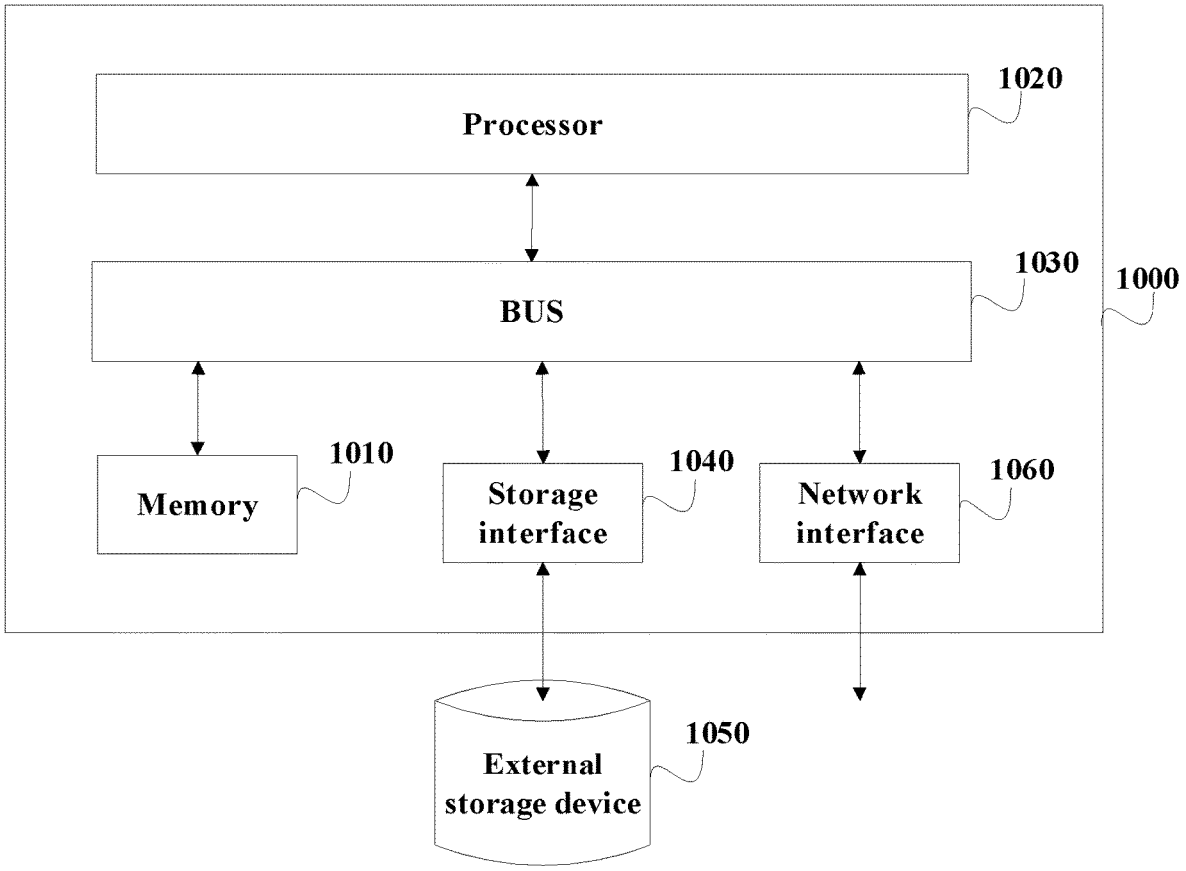
FIG. 10 is a schematic structural view showing a compensation device for a display screen according to another embodiment of the present disclosure.

In some embodiments, it may also be that, as shown in FIG. 10, the compensation device 1000 comprises a memory 1010 and a processor 1020. The processor 1020 is coupled to the memory 1010 via a bus 1030. The compensation device 1000 may also be connected to an external storage device 1050 via a storage interface 1040 for calling external data, and may also be connected to the network or another computer system (not shown) via an network interface 1060. It will not be introduced in detail here.

In this embodiment, the memory stores the data instructions, and the processor processes the above-described instructions. By adjusting the charging time for different areas, the charging rate of the entire display may be made as consistent as possible. By compensating the grayscale, it is possible to allow that the display screen when displaying an image may reach a desired target grayscale value, thereby improving the display effect.

In some embodiments, a display device is also provided in the embodiments of the present disclosure. The display device comprises the compensation device as described above (e.g., the compensation device shown in FIG. 8, 9, or 10). For example, the display device may comprise a mobile phone, a tablet computer, a notebook computer, or the like.

In some embodiments, the display device further comprises a display screen. The display screen comprises a plurality of rows of sub-pixels. The sub-pixels in a same row have a same color. The sub-pixels in the i-th row and the sub-pixels in the (i−1)-th row have different colors.

In some embodiments, the plurality of rows of sub-pixels comprise a plurality of sub-pixel groups. Each of the plurality of sub-pixel groups comprises adjacent red, green, and blue sub-pixel rows. The adjacent red, green, and blue sub-pixel rows in the each of the plurality of sub-pixel groups share one gate driving unit.

In some embodiments, a computer readable storage medium is also provided in the embodiments of the present disclosure. The computer readable storage medium has stored thereon computer program instructions which, when executed by a processor, implement the steps of the method in the embodiments corresponding to FIG. 1 and/or 7. Those skilled in the art will appreciate that the embodiments of the present disclosure may be provided as a method, device, or computer program product. Accordingly, the present disclosure may take the form of an entirely hardware embodiment, an entirely software embodiment, or a combination of software and hardware aspects. Moreover, the present disclosure may take the form of a computer program product embodied in one or more computer-usable non-transitory storage media (comprising but not limited to disk memory, CD-ROM, optical memory, and the like) containing computer usable program codes therein.

The present disclosure is described with reference to the flow charts and/or block diagrams of methods, devices (systems), and computer program products according to the embodiments of the present disclosure. It will be understood that each step and/or block of the flow charts and/or block diagrams as well as a combination of steps and/or blocks of the flow charts and/or block diagrams may be implemented by a computer program instruction. These computer program instructions may be provided to a processor of a general purpose computer, special purpose computer, an embedded processing machine, or other programmable data processing devices to produce a machine, such that the instructions executed by a processor of a computer or other programmable data processing devices produce a device for realizing a function designated in one or more steps of a flow chart and/or one or more blocks in a block diagram.

These computer program instructions may also be stored in a computer readable memory that can guide a computer or other programmable data processing device to operate in a particular manner, such that the instructions stored in the computer readable memory produce a manufacture comprising an instruction device. The instruction device realizes a function designated in one or more steps in a flow chart or one or more blocks in a block diagram.

These computer program instructions may also be loaded onto a computer or other programmable data processing devices, such that a series of operational steps are performed on a computer or other programmable device to produce a computer-implemented processing, such that the instructions executed on a computer or other programmable devices provide steps for realizing a function designated in one or more steps of the flow chart and/or one or more blocks in the block diagram.

Heretofore, the present disclosure has been described in detail. Some details well known in the art are not described to avoid obscuring the concept of the present disclosure. According to the above description, those skilled in the art would fully know how to implement the technical solutions disclosed herein.

The method and system of the present disclosure may be implemented in many manners. For example, the method and system of the present disclosure may be implemented by a software, hardware, firmware, or any combination of a software, hardware, and firmware. The above-described sequence of steps for the method is for illustrative purposes only, and the steps of the method of the present disclosure are not limited to the sequence specifically described above unless otherwise specifically stated. Moreover, in some embodiments, the present disclosure may also be embodied as programs recorded in a recording medium, which comprise machine readable instructions for implementing the method according to the present disclosure. Thus, the present disclosure also covers a recording medium that stores programs for performing the method according to the present disclosure.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments may be made without departing from the scope and spirit of the present disclosure. The scope of the disclosure is defined by the following claims.

What is claimed is:

1. A compensation method for a display screen, comprising:

adjusting a charging time for a plurality of areas of the display screen so that the charging time for each area to be charged is positively related to a distance from the each area to a data voltage input terminal of the display screen;

comparing a first grayscale value before compensation of a sub-pixel in an i-th row and j-th column with a second greyscale value input to a sub-pixel in an (i−1)-th row and j-th column, where i and j are both positive integers, and i>1;

searching a grayscale compensation parameter corresponding to the first grayscale value and the second grayscale value from a grayscale compensation parameter table, in a case where the first grayscale value is not equal to the second grayscale value;

compensating the first grayscale value by the grayscale compensation parameter to obtain a third grayscale value; and inputting the third grayscale value to the sub-pixel in the i-th row and j-th column for display, wherein, before comparing the first grayscale value with the second grayscale value, the compensation method further comprises: obtaining the grayscale compensation parameter table, wherein the obtaining the grayscale compensation parameter table comprises:

displaying a plurality of grayscale evaluation images by the display screen respectively, and obtaining an initial brightness value and an initial color coordinates of the display screen when each grayscale evaluation image is displayed, thereby obtaining a plurality of initial brightness values and a plurality of initial color coordinates corresponding to the plurality of grayscale evaluation images;

calculating an initial chromaticity of the display screen corresponding to each grayscale evaluation image according to the initial brightness value and the initial color coordinates corresponding to the each grayscale evaluation image;

calculating a chromaticity difference according to the initial chromaticity and a reference chromaticity, for each grayscale evaluation image, so as to obtain a plurality of chromaticity differences corresponding to the plurality of grayscale evaluation images;

obtaining an average value of the chromaticity differences and a maximum value of the chromaticity differences according to the plurality of chromaticity differences;

adjusting a grayscale value corresponding to each grayscale evaluation image input to the display screen, so that the average value of the chromaticity differences after adjustment is not greater than a first threshold and the maximum value of the chromaticity differences after adjustment is not greater than a second threshold;

calculating the grayscale compensation parameter according to the grayscale value after adjustment and the grayscale value before adjustment; and obtaining the grayscale compensation parameter table according to the grayscale compensation parameter corresponding to each grayscale evaluation image.

2. The compensation method according to claim 1, wherein before obtaining the grayscale compensation parameter table according to the grayscale compensation parameter corresponding to each grayscale evaluation image, the compensation method further comprises:

fitting a grayscale compensation curve according to a plurality of grayscale compensation parameters corresponding to the plurality of grayscale evaluation images; and obtaining all grayscale compensation parameters of the display screen according to the grayscale compensation curve.

3. The compensation method according to claim 1, wherein the initial chromaticity is calculated by a following equation:

$$L \times a \times b,$$

wherein, L is the initial brightness value of the display screen when the display screen displays a grayscale evaluation image, a is an abscissa value of the initial color coordinates when the display screen displays the grayscale evaluation image, and b is an ordinate value of the initial color coordinates when the display screen displays the grayscale evaluation image.

4. The compensation method according to claim 1, wherein the grayscale compensation parameter is a difference between the grayscale value after adjustment and the grayscale value before adjustment.

5. The compensation method according to claim 1, wherein the first grayscale value is equal to the third grayscale value, in a case where the first grayscale value is equal to the second grayscale value.

6. The compensation method according to claim 1, wherein the display screen comprises a plurality of rows of sub-pixels, wherein the sub-pixels in a same row have a same color, and the sub-pixels in the i-th row and the sub-pixels in the (i−1)-th row have different colors.

7. The compensation method according to claim 6, wherein the plurality of rows of sub-pixels comprise a plurality of sub-pixel groups, each of the plurality of sub-pixel groups comprises adjacent red, green, and blue sub-pixel rows, and the adjacent red, green, and blue sub-pixel rows in the each of the plurality of sub-pixel groups share one gate driving unit.

8. The compensation method according to claim 1, wherein all sub-pixels in each area are charged for a same time.

9. A compensation device for a display screen, comprising:

a memory; and a processor coupled to the memory, wherein the processor is configured to perform the compensation method according to claim 1 based on instructions stored in the memory.

10. A non-transitory computer readable storage medium having stored thereon computer program instructions which, when executed by a processor, implement the steps of the compensation method according to claim 1.

11. A compensation device for a display screen, comprising:

a time compensation circuit configured to adjust a charging time for a plurality of areas of the display screen so that the charging time for each area to be charged is positively related to a distance from the each area to a data voltage input terminal of the display screen;

a storage circuit configured to store a grayscale compensation parameter table, wherein the grayscale compensation parameter table comprises grayscale compensation parameters;

a grayscale compensation circuit configured to compare a first grayscale value before compensation of a sub-pixel in an i-th row and j-th column with a second grayscale value input to a sub-pixel in an (i−1)-th row and the j-th column, where i and j are both positive integers, and i>1, search a grayscale compensation parameter corresponding to the first grayscale value and the second grayscale value from the grayscale compensation parameter table in a case where the first grayscale value is not equal to the second grayscale value, compensate the first grayscale value by the grayscale compensation parameter to obtain a third grayscale value, and input the third grayscale value to the sub-pixel in the i-th row and j-th column for display, wherein the display screen is configured to display a plurality of grayscale evaluation images respectively; and the grayscale compensation circuit is further configured to obtain an initial brightness value and an initial color coordinates of the display screen when each grayscale evaluation image is displayed, thereby obtain a plurality of initial brightness values and a plurality of initial color coordinates corresponding to the plurality of grayscale evaluation images, calculate an initial chromaticity o the display screen corresponding to each grayscale evaluation image according to the initial brightness value and the initial color coordinates corresponding to the each grayscale evaluation image, calculate a chromaticity difference according to the initial chromaticity and a reference chromaticity, for each grayscale evaluation image, so a to obtain a plurality of chromaticity differences corresponding to the plurality of grayscale evaluation images, obtain an average value of the chromaticity differences and a maximum value of the chromaticity differences according to the plurality of chromaticity differences, adjust a grayscale value corresponding to each grayscale evaluation image input to the display screen, so that the average value of the chromaticity differences after adjustment is not greater than a first threshold and the maximum value of the chromaticity differences after adjustment is not greater than a second threshold, calculate the grayscale compensation parameter according to the grayscale value after adjustment and the grayscale value before adjustment, and obtain the grayscale compensation parameter table according to the grayscale compensation parameter corresponding to each grayscale evaluation image.

12. The compensation device according to claim 11, wherein the grayscale compensation circuit is further configured to fit a grayscale compensation curve according to a plurality of grayscale compensation parameters corresponding to the plurality of grayscale evaluation images, and obtain all grayscale compensation parameters of the display screen according to the grayscale compensation curve.

13. A display device, comprising the compensation device according to claim 11.

14. The display device according to claim 13, further comprising:

a display screen comprising a plurality of rows of sub-pixels, wherein the sub-pixels in a same row have a same color, and the sub-pixels in the i-th row and the sub-pixels in the (i−1)-th row have different colors.

15. The display device according to claim 14, wherein the plurality of rows of sub-pixels comprise a plurality of sub-pixel groups, each of the plurality of sub-pixel groups comprises adjacent red, green, and blue sub-pixel rows, and the adjacent red, green, and blue sub-pixel rows in the each of the plurality of sub-pixel groups share one gate driving unit.

* * * * *